US010930460B2

(12) United States Patent
Wu

(10) Patent No.: US 10,930,460 B2
(45) Date of Patent: Feb. 23, 2021

(54) RELAY STRUCTURE WITH HEAT DISSIPATION FUNCTION

(71) Applicant: SONG CHUAN PRECISION CO., LTD., New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 168 days.

(21) Appl. No.: 16/275,356

(22) Filed: Feb. 14, 2019

(65) Prior Publication Data

US 2020/0266017 A1 Aug. 20, 2020

(51) Int. Cl.

| | |
|---|---|
| ***H01H 50/12*** | (2006.01) |
| ***H01H 50/02*** | (2006.01) |
| ***H01H 50/14*** | (2006.01) |
| *H01H 50/36* | (2006.01) |

(52) U.S. Cl.

CPC ..... *H01H 50/12* (2013.01); *H01H 50/02* (2013.01); *H01H 50/14* (2013.01); *H01H 50/36* (2013.01)

(58) Field of Classification Search

CPC ..... H01H 50/02; H01H 50/12; H01H 50/14; H01H 50/36; H01H 2050/028; H01H 50/38; H01H 9/443

See application file for complete search history.

(56) References Cited

U.S. PATENT DOCUMENTS

| | | | | |
|---|---|---|---|---|
| 6,468,583 | B1 * | 10/2002 | Jackson | H01B 3/441 427/117 |
| 2009/0284335 | A1 * | 11/2009 | Kim | H01H 50/305 335/201 |
| 2010/0066471 | A1 * | 3/2010 | Nagura | H01H 9/047 335/201 |
| 2012/0313737 | A1 * | 12/2012 | Iwamoto | H01H 51/06 335/185 |
| 2013/0240495 | A1 * | 9/2013 | Yano | H01H 9/36 219/123 |
| 2013/0257569 | A1 * | 10/2013 | Pal | H01H 50/12 335/202 |
| 2014/0087584 | A1 * | 3/2014 | Pal | H02B 1/056 439/485 |
| 2019/0311870 | A1 * | 10/2019 | Pal | H01H 50/14 |
| 2020/0013573 | A1 * | 1/2020 | Won | B60R 16/02 |
| 2020/0234899 | A1 * | 7/2020 | Shimizu | H01H 50/12 |

* cited by examiner

*Primary Examiner* — Bernard Rojas
(74) *Attorney, Agent, or Firm* — Fei-hung Yang

(57) ABSTRACT

A relay structure with a heat dissipation function includes fixed metal plates, at least one movable metal assembly, and at least one electromagnetic unit. Each fixed metal plate is connected to a polymeric heat conductor. A tracking resistant plate is provided between the fixed metal plates. The tracking resistant plate is connected to the polymeric heat conductor for blocking a tracking occurred between the polymeric heat conductor and the fixed metal plates. The movable metal assembly is disposed at one side of the metal fixed plats. The movable metal assembly has movable contacts. The electromagnetic unit is disposed at one side of the movable metal assembly.

8 Claims, 6 Drawing Sheets

RELAY STRUCTURE WITH HEAT DISSIPATION FUNCTION

FIELD OF THE INVENTION

The present invention relates to a relay, and more particularly to a relay structure with a heat dissipation function.

BACKGROUND OF THE INVENTION

A relay is an important component in an automatic control system, which controls a large circuit system by operating a small circuit to control the opening or closing of the relay. An electromagnetic relay is one of the common types of relays. The electromagnetic effect generated by the electromagnetic device drives a movable connector to be in contact with a fixed connector, so that a large circuit system electrically connected to the fixed connector is actuated, thereby controlling the circuit system, and vice versa. The fixed connector of the relay applied to an automobile is electrically connected to the large circuit system by screwing for controlling the circuit system of the automobile automatically.

However, is not easy to operate the connection between the conventional relay and the circuit system, increasing the burden on the operator. Moreover, vehicle relays are prone to generate a large amount of thermal energy because of a long period of use. However, the heat dissipation effect of the conventional relay is poor, which may damage the relay and the circuit system electrically connected to the relay easily, resulting in a decrease in use performance.

Accordingly, the inventor of the present invention has devoted himself based on his many years of practical experiences to solve these problems.

SUMMARY OF THE INVENTION

In view of the above problems, the primary object of the present invention is to provide a relay, and more particularly to a relay structure with a heat dissipation function.

A relay structure with a heat dissipation function comprises a plurality of fixed metal plates, at least one movable metal assembly, and at least one electromagnetic unit. Each of the plurality of fixed metal plates is connected to a polymeric heat conductor. At least one tracking resistant plate is provided between any two of the fixed metal plates. The tracking resistant plate is connected to the polymeric heat conductor for blocking a tracking occurred between the polymeric heat conductor and any two of the fixed metal plates. The movable metal assembly is disposed at one side of the metal fixed plats. The movable metal assembly has a plurality of movable contacts. The electromagnetic unit is disposed at one side of the movable metal assembly. Thereby, an electromagnetic effect formed by the electromagnetic unit after electrified drives the movable metal assembly to move for the fixed metal plates and the movable contacts to be in a closed or open state, thereby forming an electrical connection or disconnection. In this way, at the moment when the electricity is connected or disconnected, a large amount of thermal energy of the metal fixed plates can be dissipated by the polymeric thermal conductor, so that the relay structure of the invention has good use efficiency when applied to an automobile.

Each of the fixed metal plates is adhered to the polymeric heat conductor. Each of the fixed metal plates has a front heat convection portion, a middle heat conduction portion, and a terminal heat radiation portion. The front heat convection portion is connected to the polymeric heat conductor. The front heat convection portion forms an electric arc high-temperature forming region and a convective heat dissipation region relative to the movable metal assembly. The electric arc high-temperature forming region is opposite to the convective heat dissipation region. The convective heat dissipation region is exposed. A heat convection space is formed between the convective heat dissipation region and an outer surface of the polymeric heat conductor. The middle heat conduction portion is formed by extending and bending the front heat convection portion. The terminal heat radiation portion is formed by extending the middle heat conduction portion. A first end of the terminal heat radiation portion, opposite to a second end connected to the middle heat conduction portion, extends out of the polymeric heat conductor. Thereby, thermal energy of the electric arc high-temperature forming region is dissipated through the convective heat dissipation region and the heat convection space in a convective manner, the thermal energy is further conducted to the polymeric thermal conductor through the middle heat conduction portion to be dissipated in a heat conduction manner, and the thermal energy is further radiated through the terminal radiation portion, thereby increasing the efficiency of heat dissipation. Especially, when the relay structure is applied to an automobile, the protruding terminal heat radiation portion is electrically connected to the large circuit system of the automobile, so as to avoid the inconvenience of the conventional screwing way. The installation work of the present invention is more convenient.

In another embodiment, the first end of the terminal heat radiation portion, opposite to the second end connected to the middle heat conduction portion, is extended and bent to form an extension portion, so that the fixed metal plates each have a U shape. Therefore, the extension portion enables the terminal heat radiation portion to have a larger contact area with the air and to enhance the heat dissipation efficiency of the terminal heat radiation portion. When the present invention is applied to an automobile, the extension portion is electrically connected to the large circuit system of the automobile, which is more advantageous for the user to perform the installation work as discussed above.

Preferably, the terminal heat radiation portion is formed by extending and bending the middle heat conduction portion, and the middle heat conduction portion is disposed at a non-right angle with respect to the front heat convection portions and the terminal heat radiation portion. Thereby, the thermal resistance of the middle heat conduction portions is lowered to dissipate the thermal energy more quickly and to improve the heat dissipation effect.

The relay structure further comprises a plurality of magnetic members. The magnetic members are disposed at opposite sides of the movable metal assembly and the electric arc high-temperature forming regions of the fixed metal plates, or around the movable metal assembly and the electric arc high-temperature forming regions of the fixed metal plates. Every adjacent two of the magnetic members are opposite poles, thereby reducing the electromagnetic field interference of the external environment and eliminating an electric arc.

Furthermore, a bottom side of the polymeric heat conductor is provided with a slotted body for the polymeric heat conductor to form a closed space with the fixed metal plates and the movable contacts so as to block an electric arc generated when the fixed metal plates are electrically connected to the movable contacts, thereby increasing the use efficiency and service life of the relay structure.

In addition, the tracking resistant plate includes a plurality of tracking resistant plates. An air gap is formed between any two of the tracking resistant plates for blocking the tracking occurred between any two of the fixed metal plates, thereby increasing the use efficiency of the relay structure.

In summary, in the relay structure with a heat dissipation function provided by the present invention, by connecting the fixed metal plates to the polymeric heat conductors, the thermal energy generated when the fixed metal plates are electrically connected can be quickly dissipated. In addition, the terminal heat radiation portion not only facilitates the heat dissipation but also facilitates the installation work of the present invention.

DETAILED DESCRIPTION OF THE PREFERRED EMBODIMENTS

Figure 1:
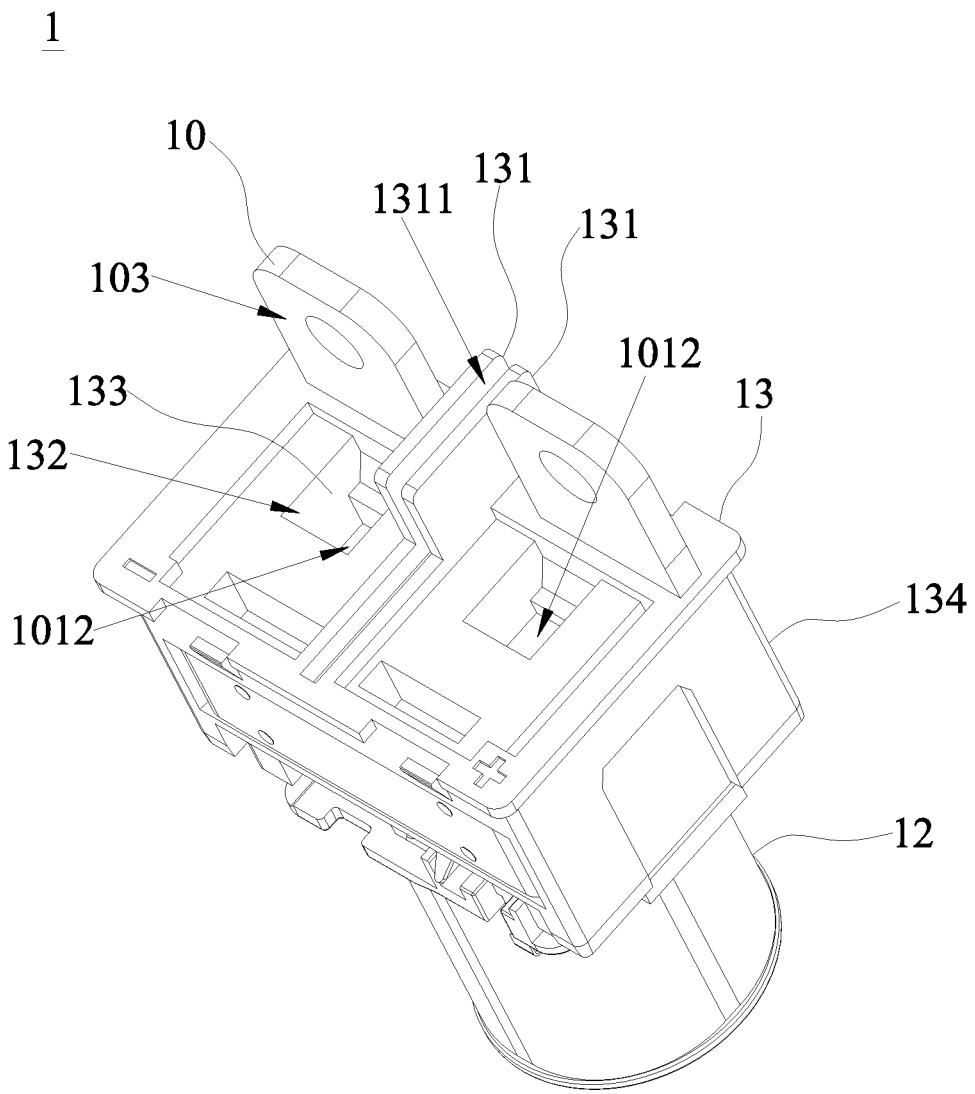
FIG. 1 is a perspective view in accordance with a preferred embodiment of the present invention.

Embodiments of the present invention will now be described, by way of example only, with reference to the accompanying drawings.

FIGS. 1-4 are a perspective view, an exploded view, a partially sectional view and a sectional schematic view in accordance with a preferred embodiment of the present invention. As shown in the figures, the present invention discloses a relay structure 1 with a heat dissipation function. The relay structure 1 comprises a plurality of fixed metal plates 10, at least one movable metal assembly 11, and at least one electromagnetic unit 12. Each of the fixed metal plates 10 is connected to a polymeric heat conductor 13. The movable metal assembly 11 is correspondingly disposed at one side of the metal fixed plats 10. The movable metal assembly 11 has a plurality of movable contacts 111. Moreover, the movable metal assembly 11 further has a movable body 112. The movable body 112 is provided with the movable contacts 111. The electromagnetic unit 12 has an electromagnetic coil 121 and is disposed at one side of the movable metal assembly 11. In this embodiment, the movable metal assembly 11 and the electromagnetic unit 12 are connected to the polymeric heat conductors 13 through a connecting member 136, and they may be connected to the polymeric heat conductors 13 in other manners. Preferably, the fixed metal plates 10 are electrically connected to a large circuit system, and the electromagnetic unit 12 is electrically connected to a small circuit system. By controlling the small circuit system, the electromagnetic effect formed by the electromagnetic unit 12 after electrified drives the movable metal assembly 11 to move for the fixed metal plates 10 and the movable contacts 111 to be in a closed or open state, thereby forming an electrical connection or disconnection to further control the large circuit system.

Furthermore, each of the fixed metal plates 10 is adhered to the polymeric heat conductors 13. In the embodiment, each of the fixed metal plates 10 is connected to the polymeric heat conductor 13 by injection molding. Each of the fixed metal plates 10 is in close contact with the polymeric heat conductor 13 to facilitate the conduction of thermal energy therein. As shown in the figures, each of the fixed metal plates 10 has a front heat convection portion 101, a middle heat conduction portion 102, and a terminal heat radiation portion 103. The front heat convection portion 101 is connected to the polymeric heat conductor 13. The front heat convection portion 101 forms an electric arc high-temperature forming region 1011 and a convective heat dissipation region 1012 relative to the movable metal assembly 11. The electric arc high-temperature forming region 1011 is opposite to the convective heat dissipation region 1012. The convective heat dissipation region 1012 is exposed. A heat convection space 132 is formed between the convective heat dissipation region 1012 and an outer surface of the polymeric heat conductor 13. The heat convection space 132 is adapted for ventilation. In addition, the middle heat conduction portion 102 is formed by extending and bending the front heat convection portion 101. The terminal heat radiation portion 103 is formed by extending the middle heat conduction portion 102. A first end of the terminal heat radiation portion 103, opposite to a second end connected to the middle heat conduction portion 102, extends out of the polymeric heat conductor 13. Preferably, in use, the connecting member of the large circuit system is electrically connected to the terminal heat radiation portion 103. Especially, when the invention is applied to the relay of an automobile, the protruding terminal heat radiation portion 103 is used for the electrical connection of the big circuit system of the automobile, without the inconvenience of traditional screwing. Therefore, the present invention provides a simple and convenient arrangement to facilitate the installation work.

Figure 3:
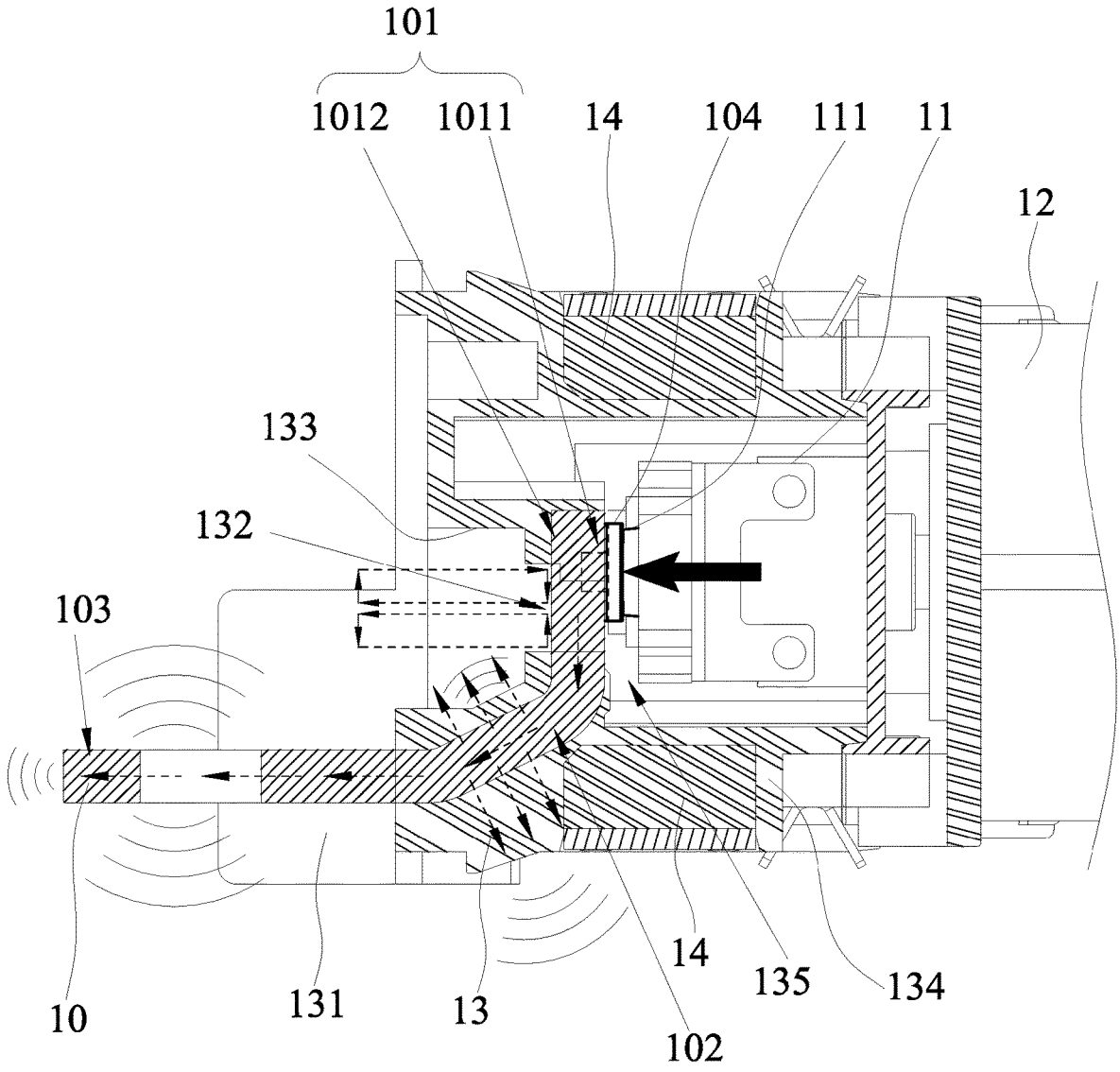
FIG. 3 is a partially sectional view in accordance with the preferred embodiment of the present invention.

When the fixed metal plates 10 and the movable contacts 111 are in a closed state, as shown in FIG. 3, a large amount of current flows through the fixed metal plates 10 and the movable contacts 111 to form an electrical connection. Therefore, a large amount of thermal energy is generated at the mutual contact point, that is, a large amount of thermal energy is generated in the electrical arc high-temperature forming region 1011. As shown in the figure, the direction of conduction of thermal energy in the metal is indicated by arrows, and the direction of conduction of thermal energy in the air is indicated by an undulate radiation pattern or a convective diagram of a heat convection loop of the closed region. Thereby, the thermal energy of each of the electric arc high-temperature forming region 1011 is dissipated by the front heat convection portion 101, the middle heat conduction portion 102, and the terminal heat radiation portion 103. First, a part of the polymeric heat conductor 13 is recessed to form a groove configuration 133, and a heat convection space 132 is formed with the convective heat dissipation region 1012, so that the convective heat dissipation region 1012 disposed opposite to the electric arc high-temperature forming region 1011 and the heat convection space 132 are adapted for ventilation, thereby allowing the thermal energy to be dissipated in a convective manner. As shown in the figure, the groove configuration 133 forms a closed region in which the heat convection loop is generated. Secondly, the middle heat conduction portion 102 is in close contact with the polymeric heat conductor 13, which is beneficial to dissipate the thermal energy in a conductive manner. The thermal energy is conducted from the electric arc high-temperature forming region 1011 to the middle heat conduction portion 102, and then conducted to the polymeric heat conductor 13 quickly for heat dissipation. A heat conductive fin formed by at least one tracking resistant plate 131 is adapted for heat dissipation. Finally, an air gap 1311 formed between the tracking resistant plate 131 and another tracking resistant plate 131 is used for heat convection to achieve efficient heat dissipation. The tracking resistant plate 131 may include a plurality of tracking resistant plates 131 to form a plurality of air gaps 1311, but not limited thereto (referring to FIG. 1 and FIG. 3), thereby enhancing the heat dissipation effect.

Figure 4:
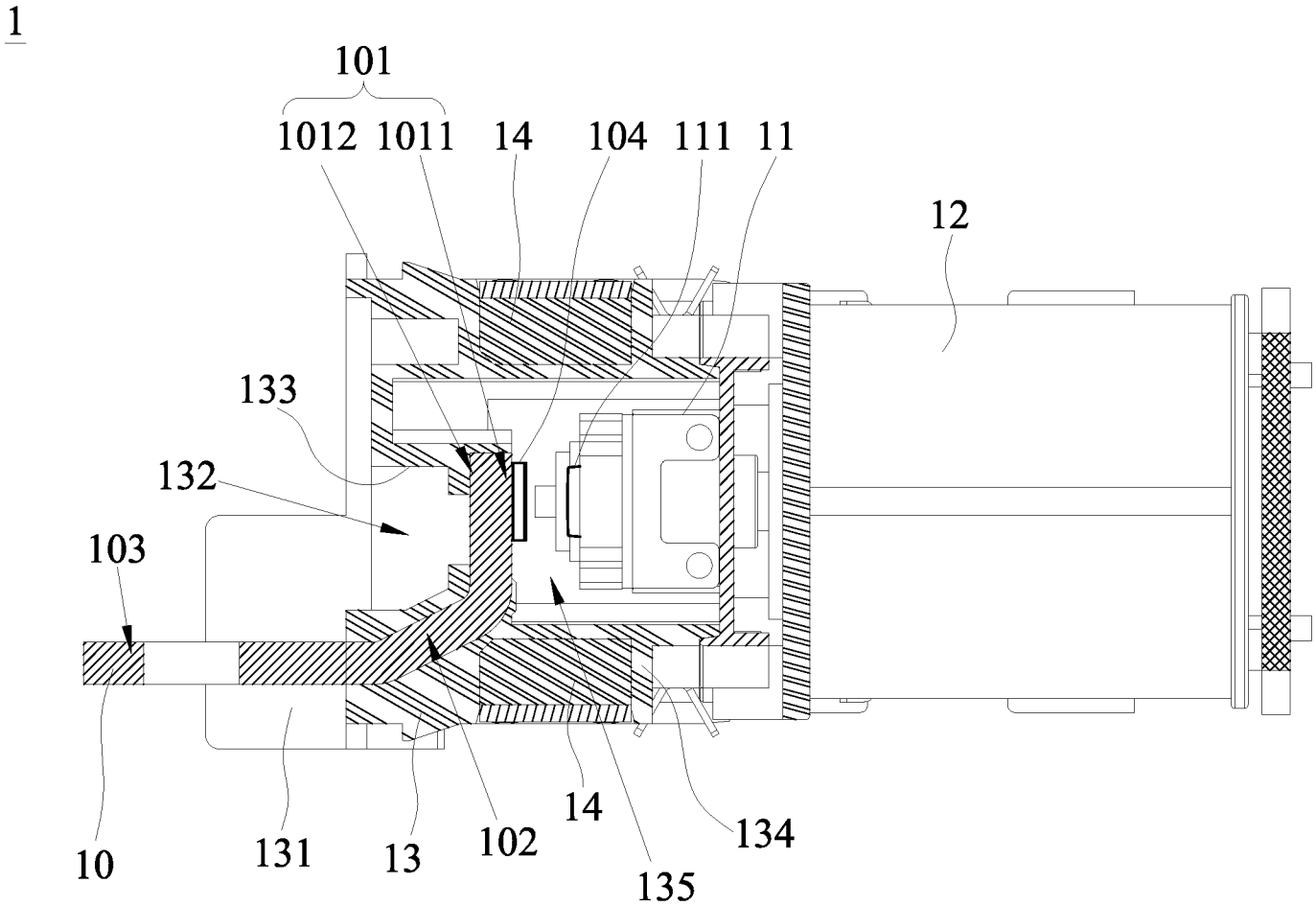
FIG. 4 is a sectional schematic view in accordance with the preferred embodiment of the present invention.

Thirdly, a part of the terminal heat radiation portion 103 extends out of the polymeric heat conductor 13 and is in direct contact with the air, which is beneficial to dissipate the thermal energy by means of heat radiation, indicated by an undulate radiation pattern formed by a plurality of arcs in the figure. As shown in FIG. 4, when the fixed metal plates 10 are in an open state with the movable contacts 111, the residual heat of the electric arc high-temperature forming regions 1011 can be dissipated by the above ways. This increases the heat dissipation efficiency to reduce the damage caused by excess heat, for example, the impedance is too big to burn and damage the circuits. Preferably, the material of the polymeric heat conductor 13 is a heat conductive plastic, which is more suitable for dissipating thermal energy.

Figure 2:
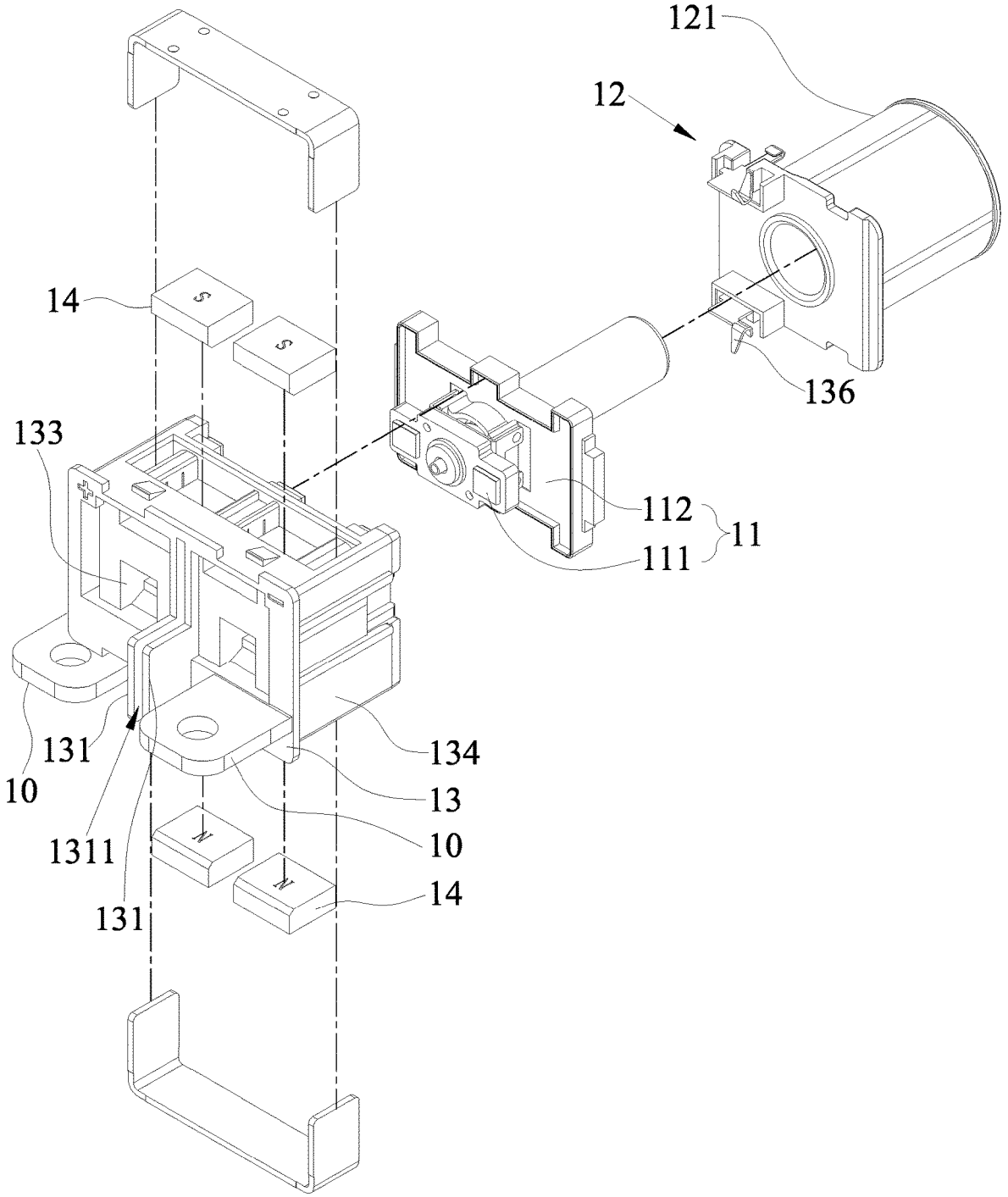
FIG. 2 is an exploded view in accordance with the preferred embodiment of the present invention.

Referring to FIG. 1 and FIG. 2, at least one tracking resistant plate 131 is provided between every adjacent two of the fixed metal plates 10. The tracking resistant plate 131 is connected to the polymeric heat conductor 13. In this embodiment, the tracking resistant plate 131 is a flat plate configuration and is plural. An air gap 1311 is formed between every adjacent two of the tracking resistant plates 131. In this way, there is a distance between every adjacent two of the tracking resistant plates 131 and between every adjacent two of the fixed metal plates 10. Therefore, the tracking resistant plates 131 can reduce the influence of the fixed metal plates 10 when they are electromagnetically activated, and can block dust or hair from falling onto the fixed metal plates 10, thereby preventing a tracking phenomenon. When dust accumulates on connectors of an electric device (outlet or connecting terminal) under humid circumstances, a tiny electrical current flows between terminals causing sparks. If this situation occurs repeatedly, a carbonized route, i.e., a track, is formed on the connector resulting in a fire. This phenomenon is called a "tracking phenomenon". Preferably, each of the tracking resistant plates 131 can avoid a tracking between the polymeric heat conductor 13 and any two of the fixed metal plates 10. Furthermore, through the tracking resistant plates 131, it is more effective to prevent the tracking between the fixed metal plates 10, thereby improving the use of the present invention.

Further, the bottom side of the polymeric heat conductor 13 is provided with a slotted body 134 for the polymeric heat conductor 13 to form a closed space 135 with the fixed metal plates 10 and the movable contacts 111. The slotted body 134 extends from the bottom side of the polymeric heat conductor 13. The movable contacts 111 and the fixed contacts 104 of the fixed metal plates 10 are located in the closed space 135 to block the electric arc generated when the contact device is electrically connected. Besides, the top side of the polymeric heat conductor 13 has a groove configuration 133 which forms the heat convection space 132 with the front heat convection portion 101 for heat dissipation during actuation, thereby improving the performance and the service life of the relay structure of the invention.

In addition, the relay structure 1 with a heat dissipation function further includes a plurality of magnetic members 14. The magnetic members 14 are disposed at opposite sides of the movable metal assembly 11 and the electric arc high-temperature forming regions 1011, or around the movable metal assembly 11 and the electric arc high-temperature forming regions 1011. In this embodiment, the present invention is provided with four magnetic members 14. The magnetic members 14 are arranged in pairs and disposed at the opposite sides of the movable metal assembly 11 and the electric arc high-temperature forming regions 1011, and are further fixed by an external retaining plate structure. The magnetic members 14 are permanent magnets. Every adjacent two of the magnetic members 14 are opposite poles. A unidirectional magnetic field is formed between the movable metal assembly 11 and the electric arc high-temperature forming regions 1011. Therefore, when the contact device is in an open or closed state, the electromagnetic field interference of the external environment can be reduced by the magnetic field. Preferably, the magnetic field can drive the electric arc to bend away from the contact device to avoid electric arc explosions.

Figure 5:
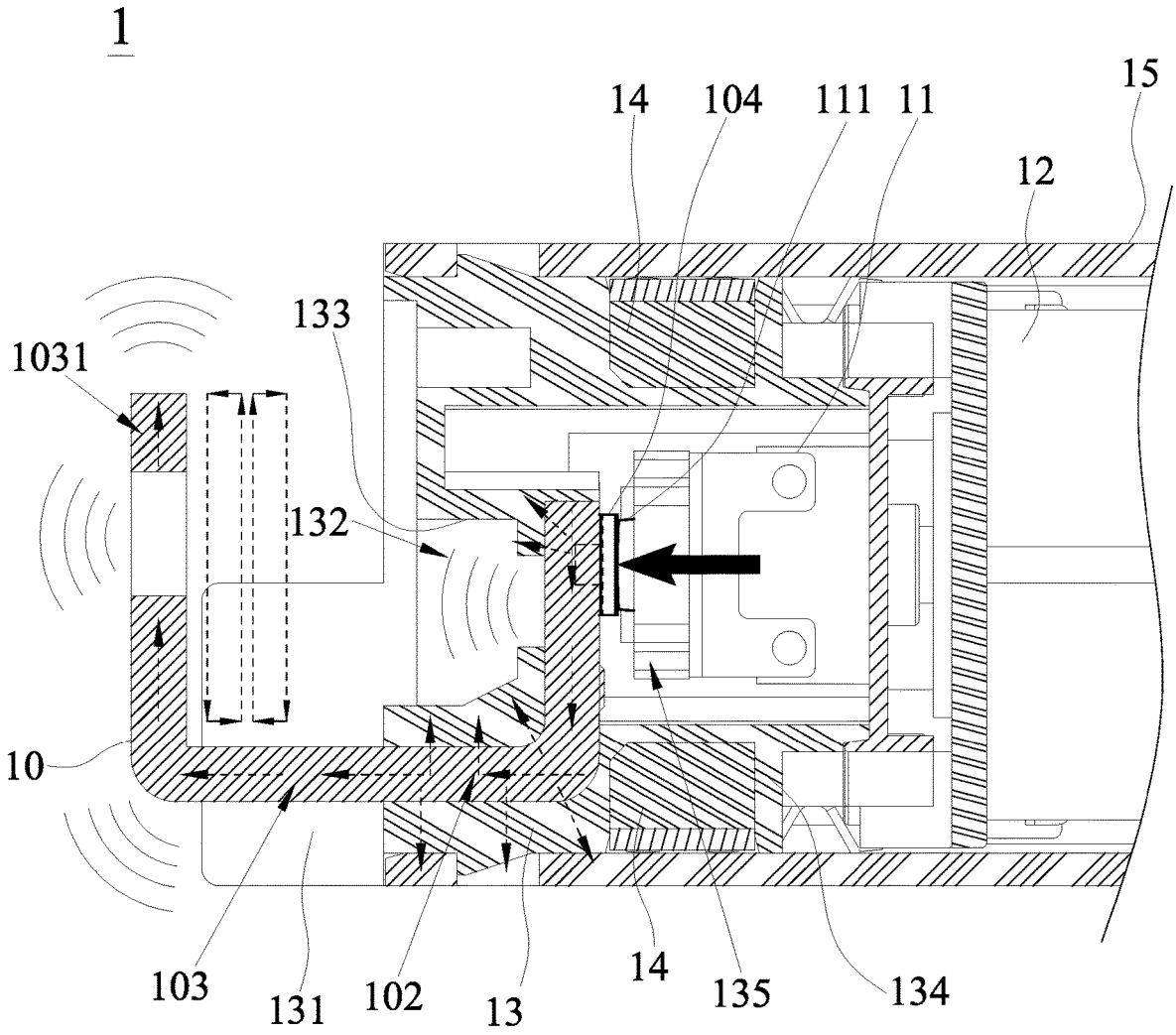
FIG. 5 is a partially sectional view in accordance with another embodiment of the present invention.

In another embodiment, as shown in FIG. 5, the first end of the terminal heat radiation portion 103, opposite to the second end connected to the middle heat conduction portion 102, is extended and bent to form an extension portion 1031. The extension portion 1031 also extends out of the polymeric heat conductor 13, so that the fixed metal plates 10 each have a U shape. When the fixed metal plates 10 and the movable contact points 111 are in a closed state, the flow of thermal energy is shown in the drawing, and the way for heat dissipation is described above for FIG. 3. Preferably, regardless of how the relay structure 1 having the heat dissipation function is placed, the thermal energy can be dissipated by means of heat convection and heat radiation through the heat convection space 132 formed by the groove configuration 133 and the convective heat dissipation region 1012. The heat dissipation space won't be limited by the extension portion 1031.

Figure 6:
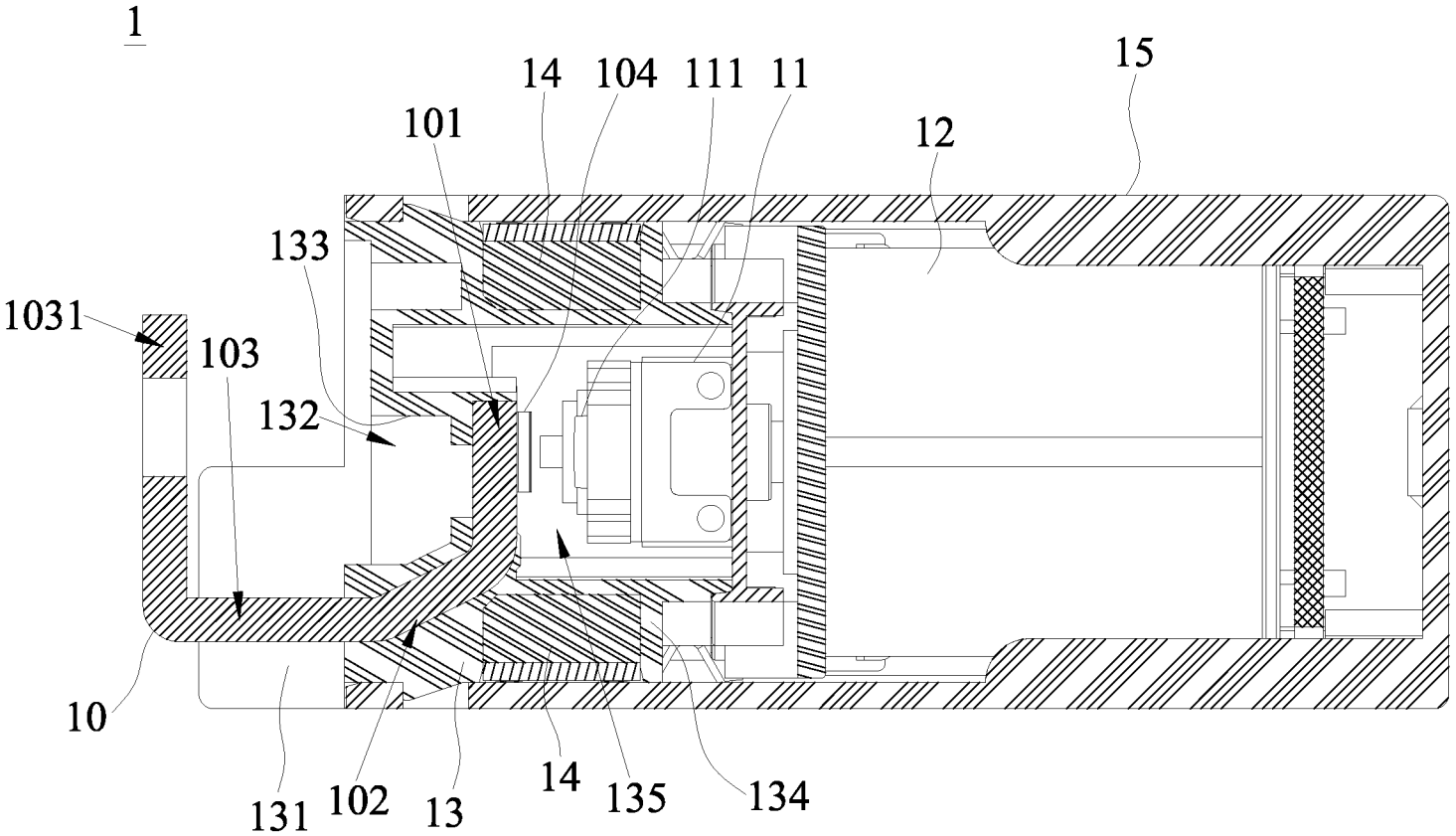
FIG. 6 is a sectional schematic view in accordance with a further embodiment of the present invention.

FIG. 6 is a sectional schematic view in accordance with a further embodiment of the present invention. The relay structure 1 with a heat dissipation function is connected in an outer casing 15 for convenient transportation or placement. The terminal heat radiation portion 103 is formed by extending and bending the middle heat conduction portion 102. The first end of the terminal heat radiation portion 103, opposite to the second end connected to the middle heat conduction portion 102, is extended and bent to form the extension portion 1031, so that the fixed metal plates 10 each have a U shape. Preferably, the middle heat conduction portion 102 has two bent configurations, that is, the middle heat conduction portion 102 is disposed at a non-right angle with respect to the front heat convection portions 101 and the terminal heat radiation portion 103. In this way, the length of the middle heat conduction portion 102 is shorter, and the thermal resistance can be reduced to dissipate the thermal energy quickly. Besides, the extension portion 1031 enables the terminal heat radiation portion 103 to have a larger contact area with the air and to enhance the heat dissipation efficiency of the terminal heat radiation portion 103. Preferably, when the present invention is applied to an automobile, it is more advantageous for the user to perform the installation work as discussed above.

In summary, the relay structure 1 with a heat dissipation function provided by the present invention has good heat dissipation and is convenient for installation. By connecting the fixed metal plates 10 to the polymeric heat conductors 13, the thermal energy generated when the fixed metal plates 10 are electrically connected can be quickly dissipated. The front heat convection portion 101, the middle heat conduction portion 102 and the terminal heat radiation portion 103 dissipate the thermal energy of the electric arc high-temperature forming region 1011 in different manners, thereby increasing the use efficiency and service life of the relay structure. In addition, the terminal heat radiation portion 103 is further electrically connected to the large circuit system to facilitate the installation work of the present invention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A relay structure with a heat dissipation function, comprising:

a plurality of fixed metal plates, each connected to a polymeric heat conductor, at least one tracking resistant plate being provided between any two of the plurality of fixed metal plates, the tracking resistant plate being connected to the polymeric heat conductor for blocking a tracking occurred between the polymeric heat conductor and any two of the plurality of fixed metal plates;

at least one movable metal assembly, disposed at one side of the metal fixed plats, the movable metal assembly having a plurality of movable contacts; and and at least one electromagnetic unit, disposed at one side of the movable metal assembly; wherein an electromagnetic effect formed by the electromagnetic unit after electrified drives the movable metal assembly to move the plurality of fixed metal plates and the plurality of movable contacts to be in a closed or open state, thereby forming an electrical connection or disconnection.

2. The relay structure as claimed in claim 1, wherein each of the plurality of fixed metal plates is adhered to the polymeric heat conductor, each of the plurality of fixed metal plates has a front heat convection portion, a middle heat conduction portion, and a terminal heat radiation portion; the front heat convection portion is connected to the polymeric heat conductor, the front heat convection portion forms an electric arc high-temperature forming region and a convective heat dissipation region relative to the movable metal assembly, the electric arc high-temperature forming region is opposite to the convective heat dissipation region, the convective heat dissipation region is exposed, a heat convection space is formed between the convective heat dissipation region and an outer surface of the polymeric heat conductor; the middle heat conduction portion is formed by extending and bending the front heat convection portion, the terminal heat radiation portion is formed by extending the middle heat conduction portion, a first end of the terminal heat radiation portion, opposite to a second end connected to the middle heat conduction portion, extends out of the polymeric heat conductor; thermal energy of the electric arc high-temperature forming region is dissipated through the convective heat dissipation region and the heat convection space in a convective manner, thermal energy is further conducted to the polymeric thermal conductor through the middle heat conduction portion to be dissipated in a heat conduction manner, and thermal energy is further radiated through the terminal radiation portion.

3. The relay structure as claimed in claim 2, wherein the first end of the terminal heat radiation portion, opposite to the second end connected to the middle heat conduction portion, is extended and bent to form an extension portion, so that the plurality of fixed metal plates each have a U shape.

4. The relay structure as claimed in claim 3, wherein the terminal heat radiation portion is formed by extending and bending the middle heat conduction portion, and the middle heat conduction portion is disposed at a non-right angle with respect to the front heat convection portions and the terminal heat radiation portion.

5. The relay structure as claimed in claim 2, further comprising a plurality of magnetic members, the magnetic members are disposed at opposite sides of the movable metal assembly and the electric arc high-temperature forming regions, or around the movable metal assembly and the electric arc high-temperature forming regions.

6. The relay structure as claimed in claim 5, wherein every adjacent two of the magnetic members are opposite poles.

7. The relay structure as claimed in claim 1, wherein a bottom side of the polymeric heat conductor is provided with a slotted body for the polymeric heat conductor to form a closed space with the plurality of fixed metal plates and the plurality of movable contacts so as to block an electric arc generated when the plurality of fixed metal plates are electrically connected to the plurality of movable contacts.

8. The relay structure as claimed in claim 1, wherein the tracking resistant plate comes in plural quantities, an air gap is formed between any two of the tracking resistant plates for blocking a tracking occurred between any two of the plurality of fixed metal plates.

* * * * *